US005206612A

United States Patent [19]

D'Oro et al.

[11] Patent Number: 5,206,612

[45] Date of Patent: Apr. 27, 1993

[54] SYSTEM FOR COMBINING HIGH FREQUENCY SIGNALS

[75] Inventors: Enzo C. D'Oro, Monza; Vittorio Tansini, Milan, both of Italy

[73] Assignee: FOR.E.M. S.p.A., Agrate-Brianza, Italy

[21] Appl. No.: 810,729

[22] Filed: Dec. 18, 1991

[30] Foreign Application Priority Data

Dec. 28, 1990 [IT] Italy ..... 22559 A/90

[51] Int. Cl.[5] ..... H01P 1/213

[52] U.S. Cl. ..... 333/135; 333/209; 333/227; 333/232

[58] Field of Search ..... 333/126, 132, 135, 17.1, 333/212, 227, 230, 232, 209

[56] References Cited

U.S. PATENT DOCUMENTS

| | | | |
|---|---|---|---|
| 3,124,768 | 3/1964 | Tilston | 333/126 |
| 3,425,006 | 1/1969 | Wolf | 333/228 |
| 4,613,838 | 9/1986 | Wade et al. | 333/232 |
| 4,677,402 | 6/1987 | Cesani et al. | 333/212 X |
| 4,890,078 | 12/1989 | Radcliffe | 333/230 X |
| 5,034,707 | 7/1991 | Kagstrom | 333/126 |

FOREIGN PATENT DOCUMENTS

| | | |
|---|---|---|
| 0492304 | 7/1992 | European Pat. Off. . |
| 2534088 | 4/1984 | France . |
| 731498 | 6/1955 | United Kingdom . |

OTHER PUBLICATIONS

IEEE Transactions on Microwave Theory and Techniques, vol. 27 No. 12, Dec. 1979, pp. 982–986.

U.S. patent application Ser. No. 07/811,713, filed Dec. 20, 1991.

*Primary Examiner*—Paul Gensler

[57] ABSTRACT

Numerous high frequency signals are combined in a system of cavity band-pass filters. Each filter has a bottle shape so that adjacent filters may be fitted together into a compact system. Bridges connect the adjacent filters.

13 Claims, 5 Drawing Sheets

SYSTEM FOR COMBINING HIGH FREQUENCY SIGNALS

BACKGROUND OF THE INVENTION

1. Field of the Invention

The present invention relates to a system for combining at least two signals having frequency bands different rom one another. One signal may be within the hundreds of Mhz range and a second signal may be within the tens of Gigahertz range. More particularly, the present invention relates to a system including numerous band-pass filters and ancillary circuits for each band to be combined, as well as a bridge or circuit connecting the filters. The invention also includes the combiner devices resulting from the system implementation.

2. Description of the Related Art

Combining two or more signals having different frequency bands on a sole carrier device, e.g., a cable, is a frequently encountered problem in the telecommunication's field. The combination must be made with the minimum possible space requirement by a device including, in addition to channel filters, auxiliary circuits that survey the characteristics of the signals to be combined, and signal the status of filters to control circuits, e.g., by motors. Tuning of filters must be made automatically.

The simplified scheme of FIG. 1A shows the frequency bands B1, B2, . . . Bn of the signals to be combined, and FIG. 1B represents blocks of circuits. F1, F2, . . . Fn are filters through which the frequency bands B1, B2, . . . Bn pass. C1, C2, . . . Cn indicate the ancillary circuits associated with each filter.

FIG. 2 represents the schematic front view of a combining circuit made up using the known techniques for combining two or more signals each having a band B1, B2, . . . Bn. Each filter F1, F2, . . . Fn is represented by a parallelepiped-shaped box (generally a resonant cavity) attached to box C1, C2, . . . Cn holding the ancillary circuits. A coupling line is provided at the output of each filter and is joined externally to two connectors Sa and Sb. The output Sb of each filter is joined to the input Sa of the following filter. The connector Sa of the first filter is closed on a reactive load (CR) that, without dissipating power, causes the signal coming from the input of each filter to be transmitted towards the input connector of the following filter.

The signals B1, B2, . . . Bn are assembled on the connector Sb of the first filter. These signals come from the input of all filters F1, F2,. . . Fn. CO' indicates the connection cable between C1 and F1 (FIG. 2*b*). This circuit has a series of drawbacks, such as excessive space requirements and difficulty of circuit connections among the filter couples.

SUMMARY OF THE INVENTION

A first object of the invention is to provide a system that avoids the drawbacks of the known system and has limited total space requirements, low losses, but also high efficiency, e.g., in the filter connections.

This objective and other objectives are obtained by the system according to the invention that includes numerous cavity band-pass filters. Each cavity includes a major base body having a section of, e.g., rectangular or quadrangular form, and a minor tapered body substantially trapezoidal in form. A box is provided for the ancillary circuits and has a width substantially equal to the width of the minor side of the top tapered body.

The system of the invention is based on the observation that a portion of the conventional band-pass filters near to the corners, does not provide a significant contribution to the quality of the filters, and therefore it can be eliminated.

Also, the relationship or ratio between the dimensions of the band-pass filters and the dimensions of the ancillary circuits associated therewith is optimized in the invention. The width of the ancillary circuits is a third of the width of the filters. Space between the ancillary circuits is wasted and can be used by rotating adjacent filters, e.g., 180°.

In order to maximize the use of space in the system and minimize the length of the connection circuit, the corners of the conventional band-pass filters were eliminated adjacent to connectors Sa and Sb.

Other features and advantages of the present invention will become apparent from the following description of the invention which refers to the accompanying drawings.

DETAILED DESCRIPTION OF THE PREFERRED EMBODIMENTS

Figure 1A:
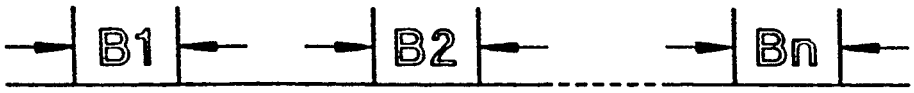
FIG. 1*a* is a schematic of the representation of the frequency bands that are combined.
Figure 1B:
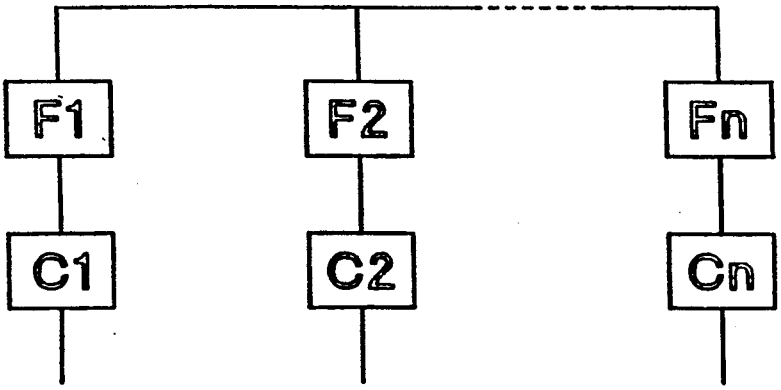
FIG. 1*b* is a block diagram representation of circuits for combining the frequency bands shown in FIG. 1*a*.
Figure 2:
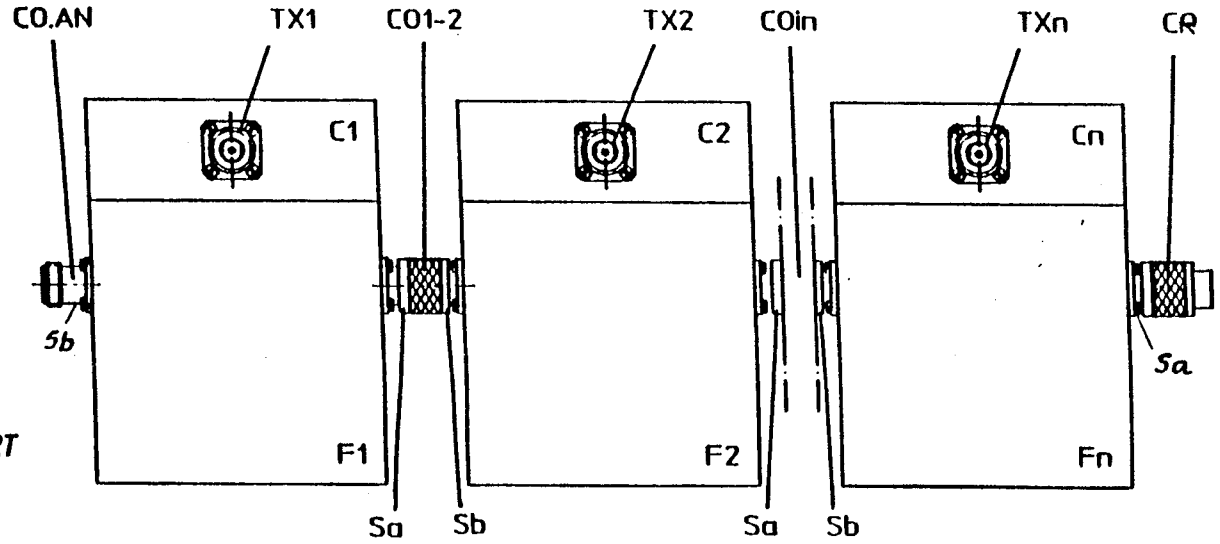
Fig. 2 PRIOR ART
FIG. 2 is a schematic front view of a known circuit for combining the frequency bands shown in FIG. 1.
Figure 2B:
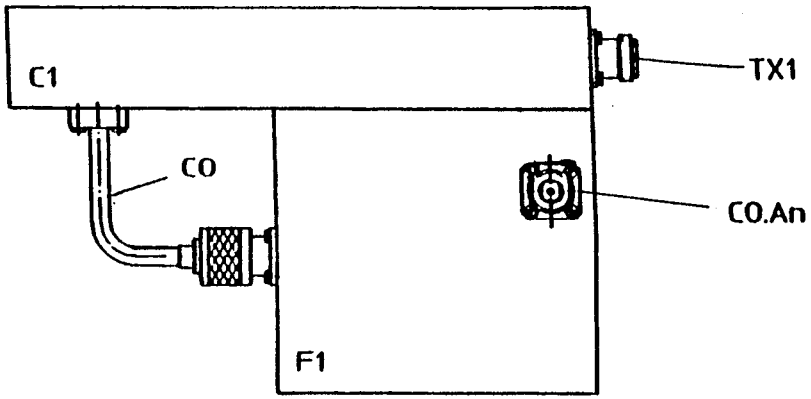
FIG. 2*b* is a schematic representation of a portion of the known circuit shown in FIG. 2.

According to a first feature of the invention, each filter Fi has (FIGS. 3*a*–3*c* and 4*b*) a configuration including two lateral plane and parallel walls 50 and 51, a preferably trapezoidal portion including two sloped sides 52 and 53 and top part 54 which is parallel to, but much smaller than, the bottom or base 55.

Preferably, the slope of sides 52 and 53 is 45°. Box 60 houses an ancillary circuit and has a width 62 substantially equal to the width of top part 54, and a height H (see FIG. 3*b*).

The tapered configuration (trapezoidal or equivalent triangular shape) of the sides 52 and 53 and the top part 54 of each filter and also the width 62 of the ancillary circuits is substantially equal to the width of top part 54 to achieve an advantageously critical juxtaposition of the filters (and of related ancillary circuits). As can be better seen in FIG. 5, which illustrates for clarity's sake a typical (but not limitative) combiner made up of five filters F1, F2, F3, F4 and F5 (each with related ancillary circuits indicated by C1 to C5), the filter F2 is oriented 180° with respect to the preceding filter F1 in the sense that F1 has side 51 facing side 61 of C2 while the side 50 of filter F2 is facing side 60 of C1.

Side 52 of the filters, e.g., F1, can directly face side 53 of the following filter.

It is extremely advantageous and simple to couple adjacent filters e.g., F1 and F2, by applying a bridge 1-2 in a box 12', e.g., of rectangular shape, whose major side "1" is preferably orthogonal to side 52 of F1 and 53 of F2.

This achieves a reduction in the overall dimensions because of the configuration, i.e., the trapezoidal form of each filter, the 180° -overturning in succession of the filters, placement of wall 52 of F1 very close to wall 53 of F2, and an easy, reliable and non-dispersive connection between the filters by the bridges or U-bridges 1-2, 2-3, 3-4, 4-5 that connect two sloped, flanked sides of two adjacent filters.

Figure 6:
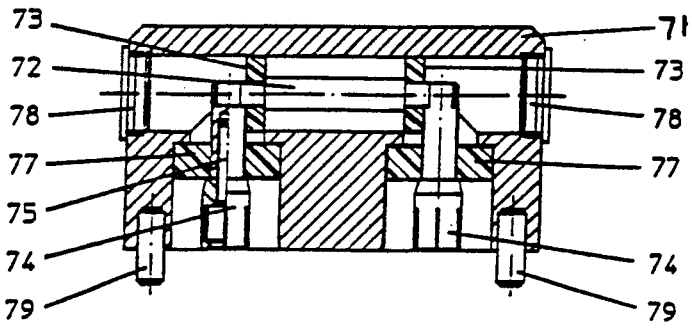
FIG. 6 is a schematic and cross-sectional view of one bridge taken along line Y—Y of FIG. 5.

A connection bridge in accordance with the invention is represented in FIG. 6 and includes an external body 71, a first internal (horizontal) lead 72, sleeves 73 and 77 made e.g., of PTFE (polytetrafluorethylene), two other vertical leads (not represented), a threaded pin 75, clips 74, caps 78 and pins 79.

The invention can be carried out by replacing the U-bridge described above with bridges of other types.

Figure 4B:
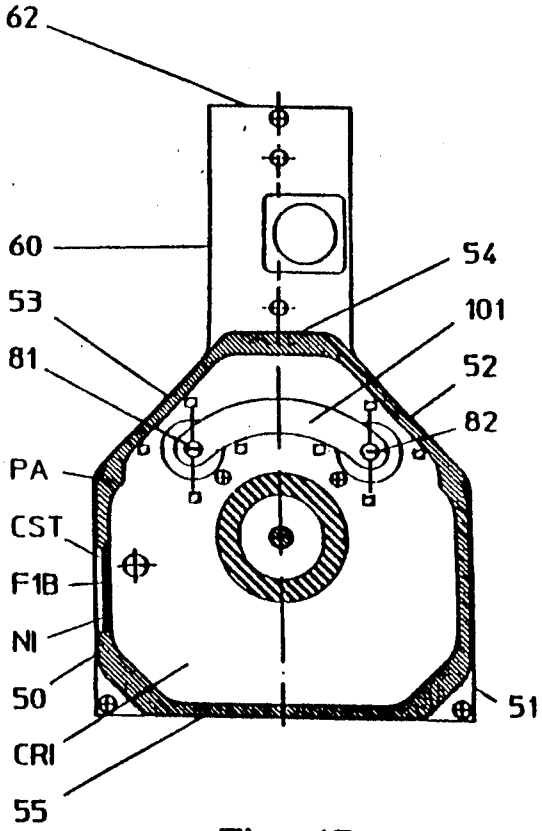
FIG. 4*b* is a cross-sectional view of the filter taken along line B—B of FIG. 4*a*.
Figure 5:
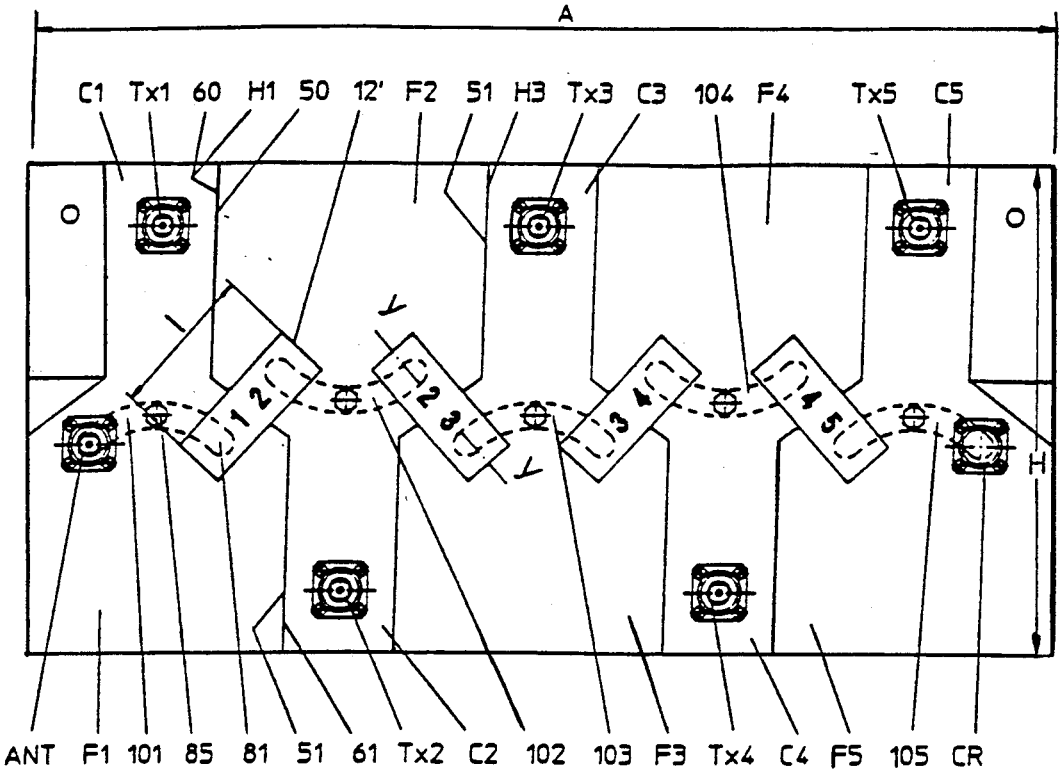
FIG. 5 is a schematic plan view of a combiner according to the invention, including five single filters indicated as 1 to 5 in FIGS. 3*a*–3*c* and 4*a*–4*b*, each filter being rotated 180° with respect to the preceding filter, each couple of filters being provided with connection bridges 1-2, 2-3, 3-4 and 4-5, respectively.

Referring to FIG. 5, a U-bridge, e.g., 1-2, between the filters F1 and F2 forms a bridge between the end 81 of the connection line 101 of filter F1 and the end 82 of the line 102 in the filter F2. FIG. 4*b* shows better a line, e.g., 101 which joins the antenna connector ANT with the internal connector of the cavity CR1.

Preferably, the length of each of said lines 101 to 105 is adjusted by forming some as a curved plate (in circular, elliptic sector forms, etc.) and adjusting the distance of each line from the wall PA of the cavity CR1 by an external screw 85, that moves the line toward and away from the wall PA of the cavity CR1, optimizing its coupling.

Figure 4A:
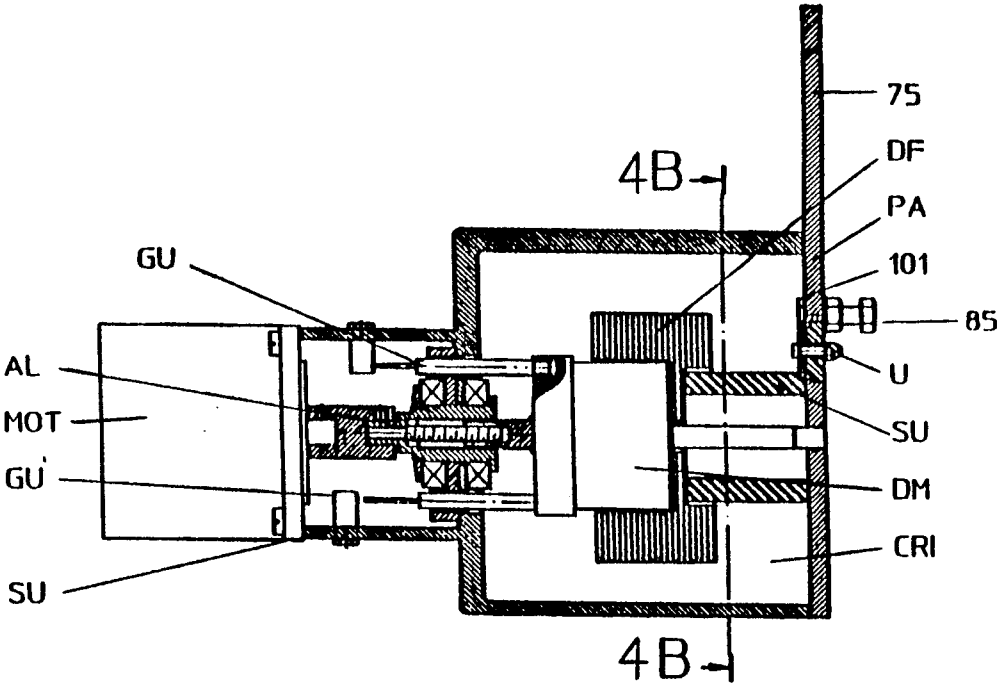
FIG. 4*a* is a cross-sectional view of the filter taken along line A—A in FIG. 3*c*.

FIGS. 4*a* and 4*b* represent the most preferred embodiment of the invention, in which resonant cavity CR1 includes a resonator, tuning of which is adjusted by two dielectric elements. A first dielectric element is a female element Df and the second one is a male element Dm, that is moved within Df and is supported by two concentrical guides GU and by a central screw of shaft AL driven preferably by a motor MOT. In this manner, by changing the coupling (that is, the penetration of Dm into Df), it is possible to perfectly tune the cavity CR1 and the related filter F1 within a wide frequency range.

The embodiment of the double dielectric resonator with penetration controlled by a manual screw or motor is described in a first patent application (European Pat. Appl. Ser. No. 0492304) whose description is herein incorporated by reference. In a similar manner, a second patent application of the Applicant (U.S. Pat. Appl. Ser. No. 811,713) describes the resonant cavity filters F1–Fn (preferably with double dielectric), each thereof including two filtering sections, a band-pass filter F1 for the high frequency signal, e.g., from 700 Mhz to 12 GHz, and a band-pass filter F1B for a low frequency control signal, e.g., tuning signal (from 0 to 300 Mhz). Advantageously, F1 is coupled by an inductance to the cavity for the high frequency signal and F1B is a printed circuit CST housed in a niche NI formed in the wall PA of the cavity CR1. The low frequency signal from the low-pass filter section F1B controls the motor MOT. Moving the male dielectric Dm and adjusting its penetration "p" in the female dielectric DF adjusts the tuning of the filter. The remote controlled motor system has a wide and very useful application in telecommunication by mobile radio sets. The description of the second contemporaneous patent application of the Applicant is also herein incorporated by reference, as it relates to its embodiment of a low-pass filter section with a printed circuit CST inserted in the niche NI, and of the band-pass filter section coupled with inductance and without capacitance.

Cavity CR1 is provided with a first support SU for the motor MOT on one side and with a support plate 75 for the box 60 for the ancillary circuits, the plate acting also as a cover for CR1. (See FIG. 4A.)

Figure 3C:
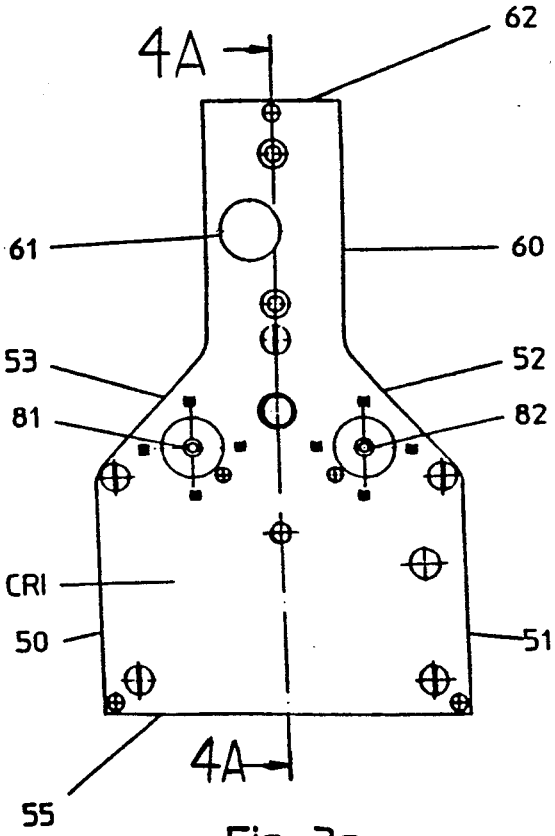
FIGS. 3*a*, 3*b*, and 3*c* represent schematical and partial views of the structural configuration of a filter according to the invention, the views being, respectively, rear view (FIG. 3*a*), lateral view (FIG. 3*b*) and front view (FIG. 3*c*).
Figure 3B:
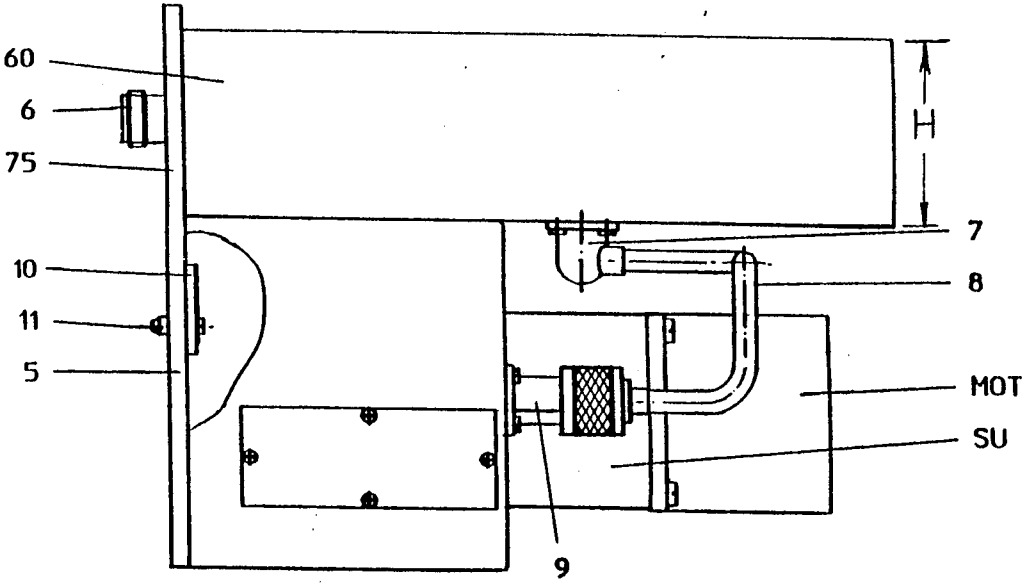
Figure 3A:
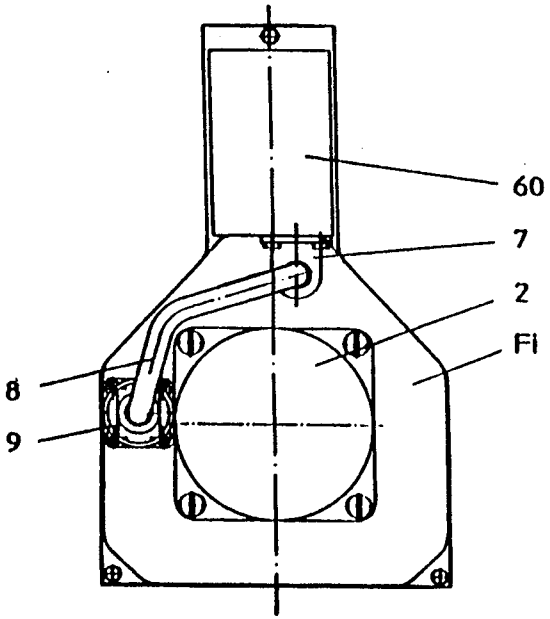

Plate 75 has two functions, i.e., cover for the filter and support for the box 60. With reference to FIGS. 3*a* and 3*b*, the signal that must be sent through filter F1 to the antenna ANT together with the signals coming from the other filters F2 Fn, is sent to the connector 6 (FIG. 3*b*) that forms the input of the box 60. After that, a smaller amount of the signal has been extracted to relay information to the auxiliary circuits on its status. The status of the same signal is sent through the output connector 7 and the cable 8 (FIG. 3*a*) to the input connector 9 of the filter (see also FIG. 3*b*).

A part of the signal is reflected by the filter and reaches the box 60 and supplies thereto information on the filter tuning status through the cable 8 and the connector 7. The package of information collected by the box 60 is processed by the ancillary circuits in box 60 and are used for sending the controls to the motor MOT that automatically tunes the filter (changing the penetration of the male dielectric Dm into the female dielectric Df).

The invention has been described with reference to some embodiments, in particular to the embodiments relating to a motor MOT to displace a dielectric element as shown in FIGS. 3*b* and 4, and provide printed circuit filter CST shown in FIG. 4B in the niche NI of the wall PA.

Although the present invention has been described in connection with the preferred embodiment thereof, many other variations and modifications will now become apparent to those skilled in the art without departing from the scope of the invention. It is preferred, therefore, that the present invention be limited not by the specific disclosure herein, but only by the appended claims.

We claim:

1. A system for coupling a plurality of high frequency band signals, comprising a plurality of cavity band-pass filters, each filter comprising: a box for containing an ancillary circuit; output and input connectors for coupling the filters together; and a housing, the housing including a base body and a tapered top body located above the base body, the top body having a substantially trapezoidal cross-section, the box having a width substantially equal to a width of a smallest side of the top body.

2. The system of claim 1, wherein the base body has a rectangular cross-section.

3. The system of claim 1, wherein the base body has a quadrangular cross-section.

4. The system of claim 1, wherein the base body, the tapered top body and the box have a combined bottle shape when viewed from a side thereof.

5. The system of claim 2, wherein adjacent cavity band-pass filters of the system are oriented in opposing directions, a side of the base body of one cavity band-pass filter fitting together with a side of the box of an adjacent cavity band-pass filter.

6. The system of claim 1, wherein non-parallel sides of the top body both have a slope of about 45 degrees.

7. The system of claim 1, wherein the output and input connectors for coupling a cavity band-pass filters comprise a plurality of bridges.

8. The system of claim 7, wherein each bridge has a U-shape.

9. The system of claim 7, wherein each bridge is oriented at a 90° angle with respect to two adjacent sides of the top bodies of two adjacent cavity band-pass filters.

10. The system of claim 1, further comprising a plurality of curved laminae and dielectric screws, one laminae being located in each cavity band-pass filter at a predetermined distance from an internal surface of the cavity band-pass filter containing the laminae, and one dielectric screw extending through a wall of each cavity band-pass filter and being in contact with the laminae contained therein, the distance of a laminae from the internal surface of a cavity band-pass filter containing the laminae being adjustable by turning the screw of the filter.

11. The system of claim 10, further comprising two dielectric elements for each cavity band-pass filter for regulating the cavity resonance of each filter.

12. The system of claim 11, wherein the dielectric elements are automatically controlled.

13. The system of claim 11, further comprising a plurality of low-pass filters, one low-pass filter being located in each cavity band-pass filter, the low-pass filter of each cavity band-pass filter being controlled by the dielectric elements of each cavity band-pass filter.

* * * * *